US006695667B1

(12) United States Patent
Kee

(10) Patent No.: US 6,695,667 B1
(45) Date of Patent: Feb. 24, 2004

(54) TOOL SET WITH HUMAN FORM CORRESPONDENCE

(76) Inventor: John Matthew Kee, 40 Greenwood Ave., Haskell, NJ (US) 07420

( * ) Notice: Subject to any disclaimer, the term of this patent is extended or adjusted under 35 U.S.C. 154(b) by 0 days.

(21) Appl. No.: 10/072,182

(22) Filed: Feb. 7, 2002

(51) Int. Cl.[7] ..... A63H 3/00

(52) U.S. Cl. ..... 446/73; 446/72; 446/86; 446/101; 446/376; 206/457

(58) Field of Search ..... 446/71, 72, 73, 446/75, 76, 85, 86, 97, 99, 101, 102, 77, 120, 121, 123, 124, 144, 268, 376, 378, 379, 382, 385, 491; 206/372, 373, 457, 374–378, 216; 7/138, 143, 165; 434/393; 81/490, 177.4; D21/532, 529, 523, 588; D3/206, 201, 269

(56) References Cited

U.S. PATENT DOCUMENTS

| | | | | | |
|---|---|---|---|---|---|
| 1,710,679 | A | * | 4/1929 | Pels | 204/1.7 |
| 3,874,113 | A | * | 4/1975 | Beck | 446/378 |
| 4,217,724 | A | * | 8/1980 | Schoenfield et al. | 273/160 |
| D261,540 | S | | 10/1981 | Appel et al. | |
| D273,212 | S | | 3/1984 | Sahler | |
| D277,203 | S | | 1/1985 | Paczko | |
| 5,078,641 | A | * | 1/1992 | Chen | 446/86 |
| 5,396,819 | A | | 3/1995 | Bradley | |
| 5,454,746 | A | * | 10/1995 | Guegan et al. | 446/72 |
| D374,466 | S | | 10/1996 | Guegan et al. | |
| 5,613,413 | A | | 3/1997 | Huang | |
| 6,237,451 | B1 | * | 5/2001 | Wei | 81/177.4 |
| 6,257,947 | B1 | * | 7/2001 | Glaser | 446/321 |

* cited by examiner

*Primary Examiner*—Derris H. Banks
*Assistant Examiner*—Bena B. Miller
(74) *Attorney, Agent, or Firm*—Gene Scott-Patent Law & Venture Group

(57) ABSTRACT

A tool set is mounted within and on a tool case having tool receiving means supporting a first portion of the plurality of hand tools within the tool case and tool attachment means engaging a second portion of the plurality of hand tools exteriorly. The tool case and the second portion of the hand tools, together, roughly resemble a human form. The tool case is generally cylindrical in shape resembling a human torso and has a side wall terminating with opposing closed ends, and provides an access door in the side wall for access to an interior space within the tool case for storage of smaller tools.

5 Claims, 4 Drawing Sheets

TOOL SET WITH HUMAN FORM CORRESPONDENCE

BACKGROUND OF THE INVENTION

1. Field of the Invention

This invention relates generally to hand tool sets and more particularly to a hand tool set which is able to be assembled in the form of a robotic structure having a human form.

2. Description of Related Art

Appel et al., U.S. Pat. No. D261,540 describes a combined toy bucket and tools therefor.

Guegan et al., U.S. Pat. No. D374,466 describes a figurine shaped screwdriver for toys.

Paczko, U.S. Pat. No. D277,203 describes a toy plier design.

Sahler, U.S. Pat. No. D273,212 describes a toy tape measure.

Bradley, U.S. Pat. No. 5,396,819 describes a socket wrench having a rotatable cylindrical body with an elongated interior channel for storing a plurality of nuts. The channel has a nut opening at a first end for receiving and removing nuts from the channel. A longitudinally slidable and axially rotatable roller grip assembly is provided on the exterior of the body. The roller grip assembly is attached to an interior backplate that moves longitudinally within the body channel. The roller grip assembly allows an operator both to urge the stored nuts toward the nut opening of the wrench, eject the nuts from the chamber, and to hold the wrench while the body is rotating.

Huang, U.S. Pat. No. 5,613,413 describes a handle for a hand tool, including a hollow handle body and a cover covered on the handle body at the bottom, wherein the handle body has a bottom chamber, an inside annular groove around the bottom chamber, a hexagonal coupling hole longitudinally disposed at the front end in communication with the bottom chamber, a transverse hole perpendicularly extending from the hexagonal coupling hole to the periphery, and a springy strip suspending in the transverse hole adjacent to the hexagonal coupling hole, the springy strip having a raised portion facing the hexagonal coupling hole for holding down a driving shaft in the hexagonal coupling hole for holding a tool bit; the cover has a plurality of split upright barrels for holding tool bits, two arched connecting walls connected between the split upright barrels, and a circular chamber defined within the arched connecting walls for holding a driving shaft, each of the split upright barrels having a transverse rib forced into engagement with the inside annular groove of the handle body.

Solutions to tool storage have been created since the first tool box was made commercially available. The prior art comprises a wide range of tool set and tool set storage boxes or cases. Such combinations are very well known. Some of these cases hold tools in formed wells such that each tool may be matched with its intended storage space. Others of these cases provide non-form fitting compartments for accepting various tools in a less organized manner. The present invention diverges from these prior art approaches by using a tool chest that is adapted for storing some of the smaller hand tools such as allen wrenches and wrench sockets within an interior space as with most tool cases, but storing larger tools externally so that the entire tool chest and tool set resemble a human figure.

SUMMARY OF THE INVENTION

The present invention teaches certain benefits in construction and use which give rise to the objectives described below.

A tool set is mounted within and on a tool case having tool receiving means supporting a first portion of the plurality of hand tools within the tool case and tool attachment means engaging a second portion of the plurality of hand tools exteriorly. The tool case and the second portion of the hand tools, together, roughly resemble a human form. The tool case is generally cylindrical in shape resembling a human torso and has a side wall terminating with opposing closed ends, and provides an access door in the side wall for access to an interior space within the tool case for storage of smaller tools. The important aspects of the invention, as described below, is to provide an organized assembly of tools to improve and make tool storage for convenient. A further value of the tool set is to create an improved understanding of the use of tools and to make leaning the use of tools and the differences between them easier to grasp.

A primary objective of the present invention is to provide an apparatus and method of use of such apparatus that provides advantages not taught by the prior art.

Another objective is to provide such an invention capable of storing a variety of tools in a manner that the tools are readily visible and convenient to select.

A further objective is to provide such an invention capable of easy assembly.

A still further objective is to provide such an invention capable of resembling a human form to create a novelty value for improving teaching of tools use and handling.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
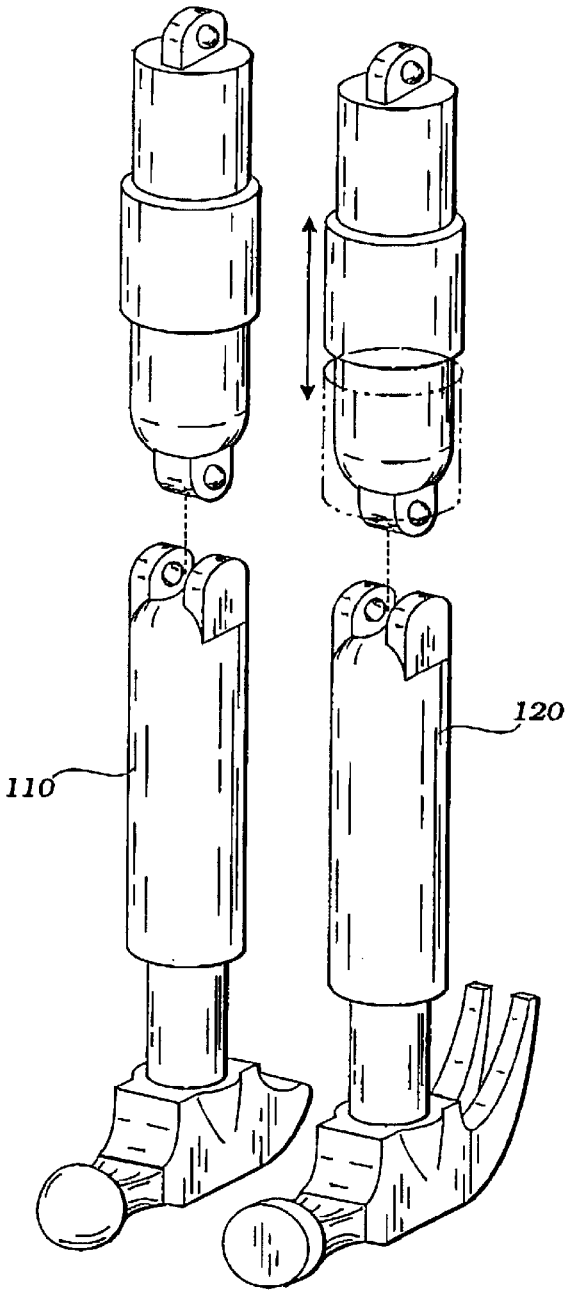
FIG. 1 is a perspective view of a set of two hammers, a ball-peen type and a carpenter's type which are used in the invention.
Figure 2:
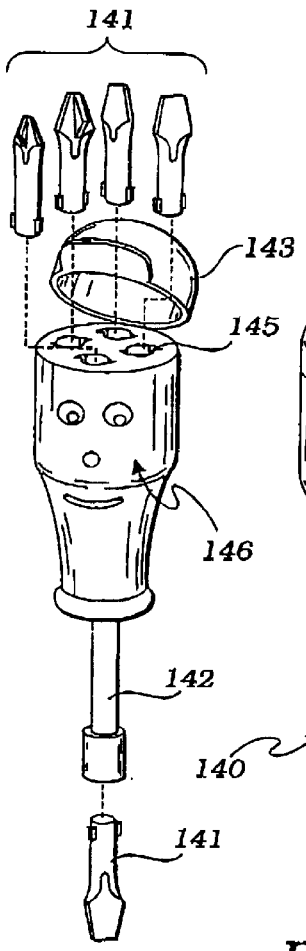
FIGS. 2, 3 and 5 are perspective views of a screwdriver thereof.
Figure 3:
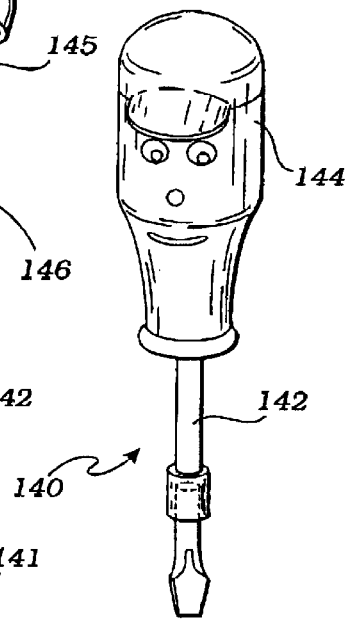
Figure 4:
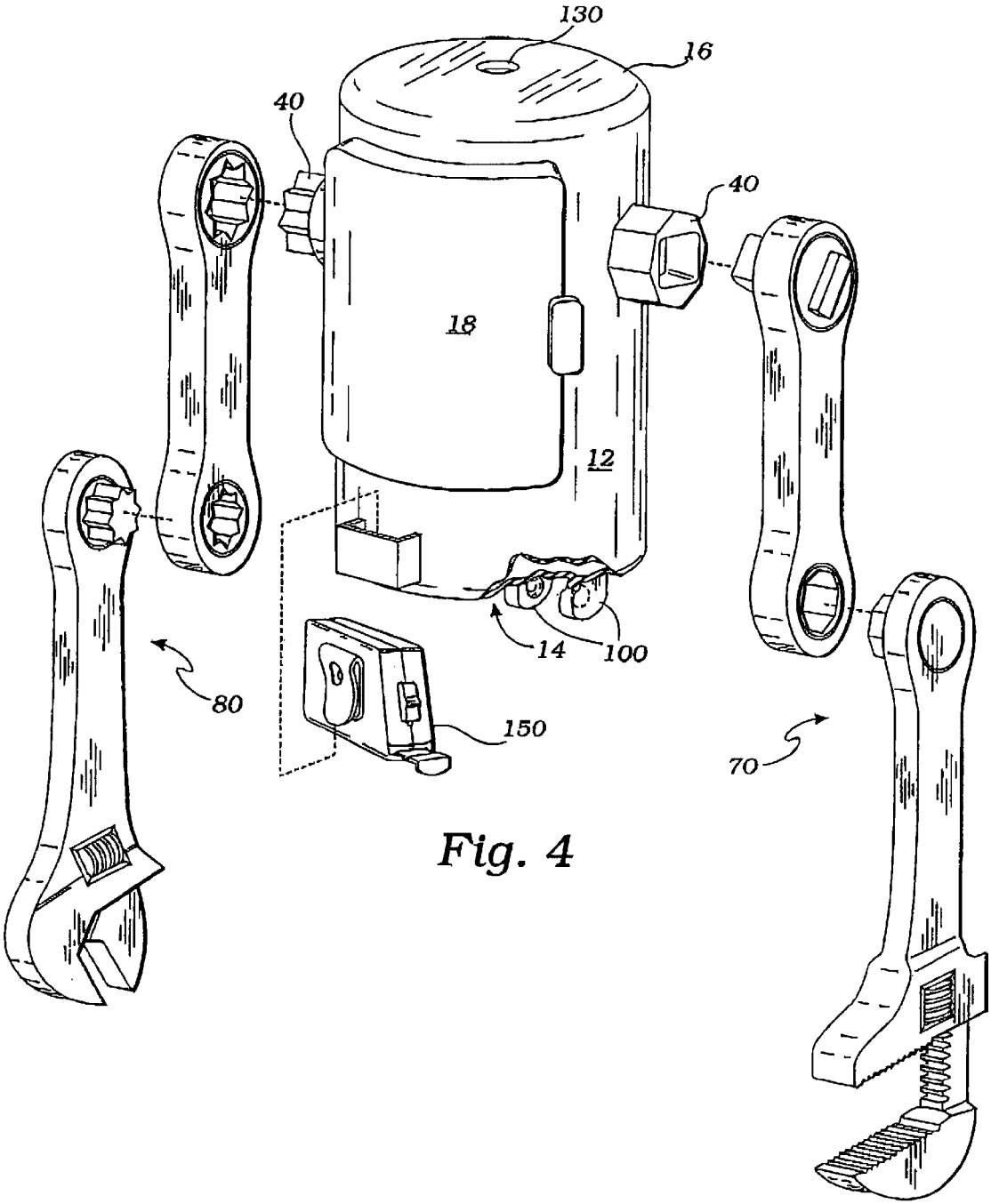
FIG. 4 is a perspective view of a tool chest and set of hand wrenches thereof.
Figure 5:
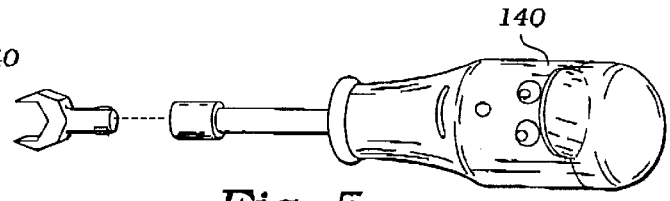
Figure 6:
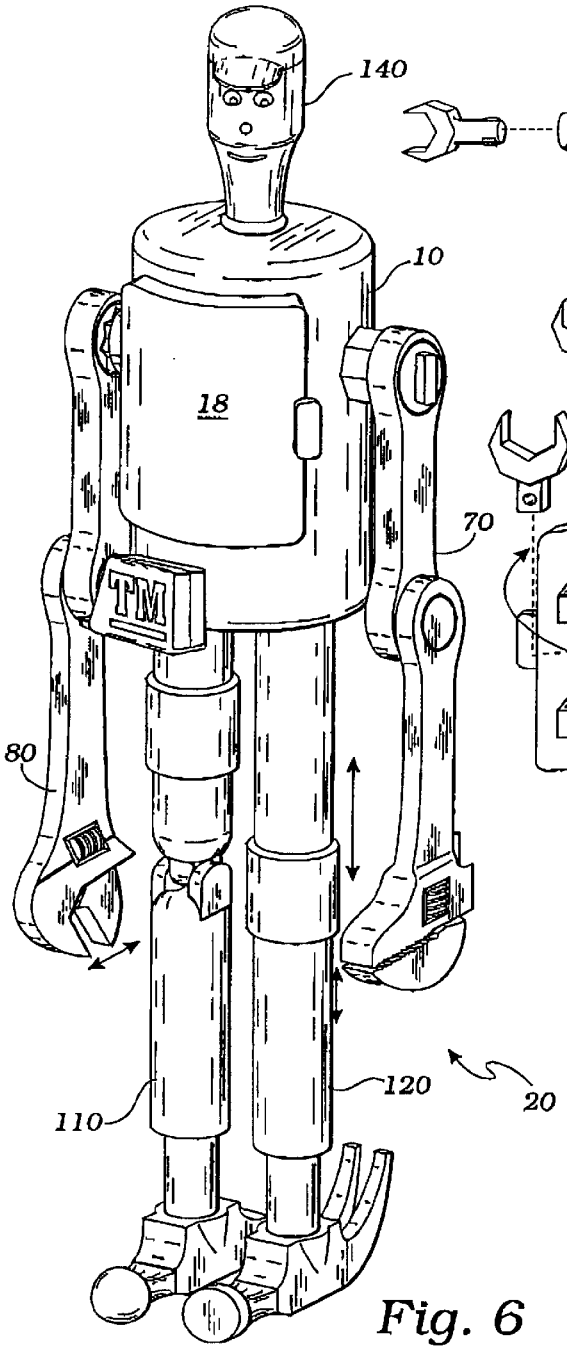
FIG. 6 is a perspective view of the entire invention tool set as assembled.
Figure 7:
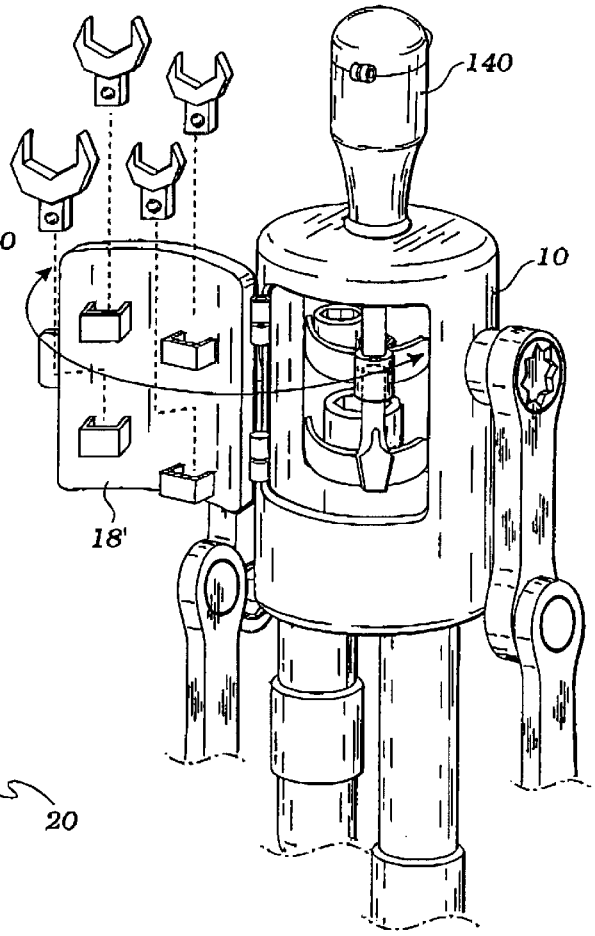
FIG. 7 is a partial view of FIG. 6 showing an alternate use of the access door of the invention for holding small open-end wrenches.
Figure 8:
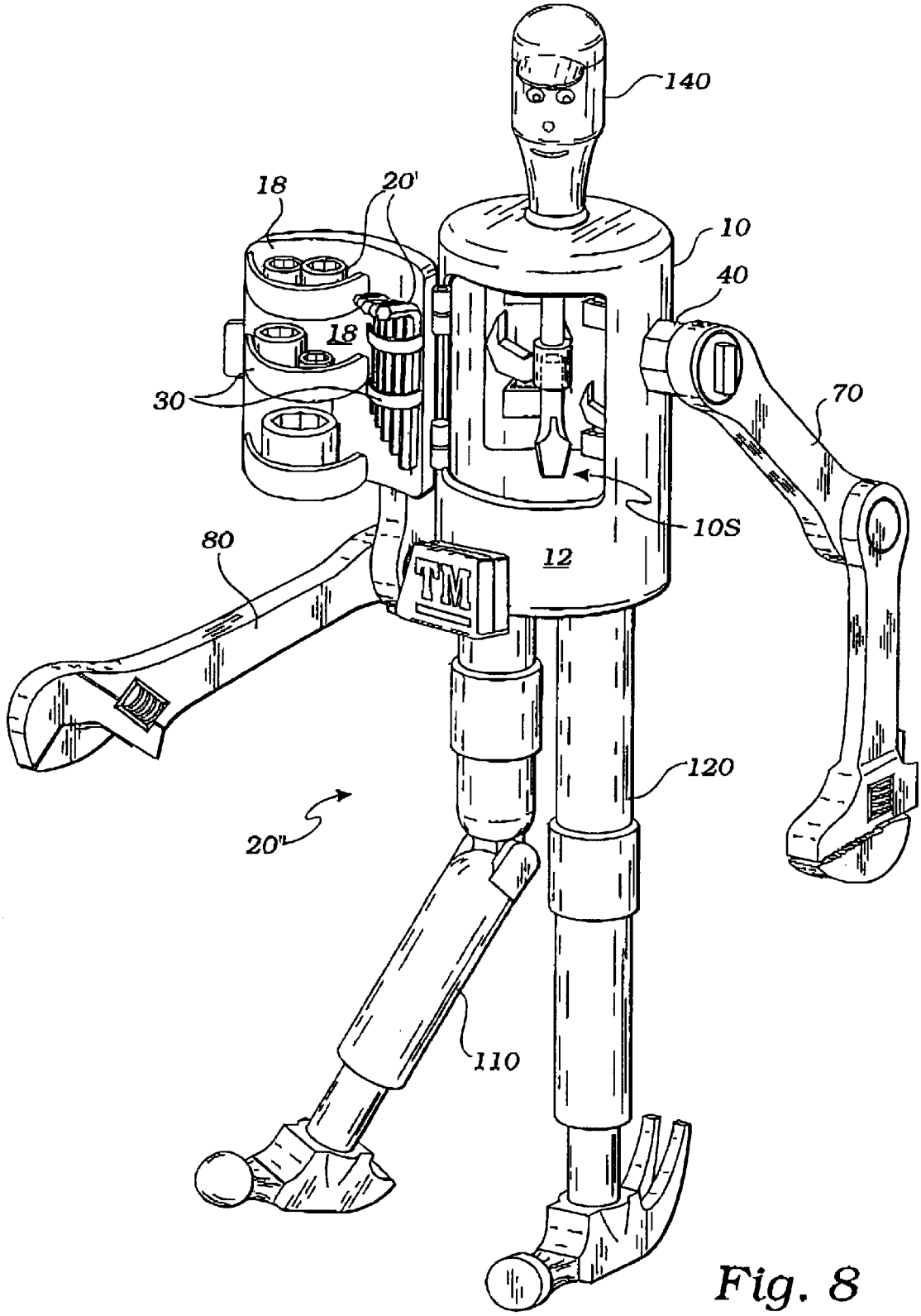
FIG. 8 is a still further view of FIG. 7 showing alternate uses and articulation of parts.

A tool set apparatus comprises a tool case 10 and a plurality of hand tools 20. The tool case 10 has a tool receiving means 30 supporting a first portion 20' of the plurality of hand tools within the tool case 10, and a tool attachment such as shown by element 40, engaging a second portion 20" of the plurality of hand tools 20 exteriorly. The tool case 10 and second portion 20" of the hand tools 20, together, are configured and arranged to bear likeness to the human form. The tool case 10 is constructed of a rigid and durable material such as sheet metal or molded plastic and is generally cylindrical in shape resembling a human torso. It provides a sidewall 12 terminating at opposing closed ends 14, 16 and provides at least one access door 18, and preferably two such doors 18, in the side wall 12 for gaining access to an interior space 10S within the tool case 10. The access doors 18 provide, a portion of the tool receiving means 30 integral with an interior surface 18' of the access door 18. The sidewall 12 provides a wrench engaging means 40, described as element 40 above, for engaging wrenches 70, 80 on each of two opposing sides of the apparatus. The wrench engaging means 40 is adapted for positioning the wrenches 70, 80 for resembling human arms and hands relative to the human torso. One of the closed ends 14 of the tool case 10, provides hammer engaging means 100 for engaging a pair of spaced apart hammers 110, 120. The hammer engaging means 100 is adapted for snap-on attachment of, and positioning of the hammers 110, 120 for resembling human legs and feet relative to the human torso. This is best seen in FIGS. 6 and 8. The other of the closed ends 16 provides a screw driver engaging means 130, for receiving a shaft 142 of a screw driver 140 within the tool case 10, with a handle 144 of the screw driver 140 extending outwardly from the other of the closed ends 16 in a position to resemble a human head. Preferably, the handle 144 provides indicia 146 resembling a human face as best seen in FIGS. 2 and 3. Preferably, the handle 144 provides a storage space 145 for various screwdriver bits 141 and these are covered with a snap-on cap 143 as shown in FIG. 2. As shown in FIG. 4, a tape rule 150 may be mounted onto the tool case 10. Clearly, the particular types of tools shown in the figures and described are only example of one possible arrangement. Other tool types and arrangements may be made which are just as functional. For instance, any other hand tool or even power tools may be utilized in the spirit of the present invention and the configuration may be that of other recognizable objects such as an animal, a tree, an automobile and so on.

In use, the present invention is not only useful as a tool kit and storage box, but is particularly useful for teaching the types of different tools that are available and their uses. It is clearly easily to relate a mechanics wrench to the left arm of the tool set and a simple adjustable hand wrench to the right arm thereof, as compared to meaningless storage slots as might be found in a standard tool box. Thus, in use the present invention is able to be used to teach the art of tools and their use. It also provides an improved motivation to return each tool to its position after use. The fact that the larger tools are stored externally to the tool box provides the benefit of being able to easily notice when a tool has not been returned to its appropriate location after use.

While the invention has been described with reference to at least one preferred embodiment, it is to be clearly understood by those skilled in the art that the invention is not limited thereto.

Rather, the scope of the invention is to be interpreted only in conjunction with the appended claims.

What is claimed is:

1. A tool set apparatus comprising a tool case and a plurality of hand tools removably engaged within the tool case as well as exteriorly to the tool case; the tool case and the hand tools, together, configured in human form; wherein the tool case is generally cylindrical in shape resembling a human torso and having a side wall terminating at opposing closed ends, and provides an access door in the side wall for access to an interior space within the tool case.

2. The apparatus of claim 1 wherein the access door provides a first storage means integral with an interior surface of the access door.

3. The apparatus of claim 1 wherein the side wall provides wrench engaging means for engaging wrenches on each of a two opposing sides of the apparatus, the wrench engaging means adapted for positioning the wrenches for resembling human arms and hands relative to the human torso resembling, tool case.

4. The apparatus of claim 1 wherein one of the closed ends provides hammer engaging means for engaging a pair of spaced apart hammers, the hammer engaging means adapted for positioning the hammers for resembling human legs and feet relative to the human torso resembling, tool case.

5. The apparatus of claim 1 wherein the other of the closed ends provides a screw driver engaging means for receiving a shaft of a screw driver within the tool case with a handle of the screw driver extending outwardly from the other of the closed ends in a position to resemble a human head.

* * * * *